US007237705B2

(12) United States Patent
Gaudron

(10) Patent No.: US 7,237,705 B2
(45) Date of Patent: Jul. 3, 2007

(54) FIRING PIN ACTUATION AND RESET MECHANISM FOR A POWDER ACTUATED SETTING TOOL AND METHOD

(75) Inventor: Paul Gaudron, Stamford, CT (US)

(73) Assignee: Powers Products III, LLC, New Rochelle, NY (US)

( * ) Notice: Subject to any disclaimer, the term of this patent is extended or adjusted under 35 U.S.C. 154(b) by 291 days.

(21) Appl. No.: 10/914,764

(22) Filed: Aug. 9, 2004

(65) Prior Publication Data

US 2006/0027087 A1 Feb. 9, 2006

(51) Int. Cl.
*B25C 1/02* (2006.01)

(52) U.S. Cl. ..... 227/9; 42/76.01

(58) Field of Classification Search ..... 227/10, 227/11, 9; 42/69.01, 1.16
See application file for complete search history.

(56) References Cited

U.S. PATENT DOCUMENTS 2,719,300 A * 10/1955 Walker ..... 227/8
2,869,127 A * 1/1959 Williams ..... 227/8
3,786,977 A 1/1974 Shamaly ..... 227/8
4,077,556 A 3/1978 Büchel ..... 227/8
5,114,064 A * 5/1992 Jochum et al. ..... 227/9
5,135,151 A * 8/1992 Logan ..... 227/9
5,170,922 A * 12/1992 Ehmig et al. ..... 227/8
6,364,190 B1 * 4/2002 Tor ..... 227/10

FOREIGN PATENT DOCUMENTS

EP 0 309 204 A2 3/1989
EP 1 120 201 A2 8/2001
GB 2 140 341 A 11/1984

* cited by examiner

*Primary Examiner*—Stephen M. Johnson
(74) *Attorney, Agent, or Firm*—Cantor Colburn LLP

(57) ABSTRACT

Disclosed herein is a method that relates to resetting and firing a powder actuated setting tool. The method includes resetting the tool by torsionally urging a portion of a firing pin into axial alignment with a finger of a barrel of the tool and compressing the barrel of the tool toward a housing of the tool. The resetting further includes the finger urging the portion of the firing pin to a ready position in response to the compression of the barrel. The method further includes firing the tool by rotating a rotator and the firing pin to a position where the portion of the firing pin is unsupported by the finger.

4 Claims, 3 Drawing Sheets

FIRING PIN ACTUATION AND RESET MECHANISM FOR A POWDER ACTUATED SETTING TOOL AND METHOD

BACKGROUND

In the construction and industrial industries, people are familiar with powder actuated setting tools. These are tools designed to forcefully expel a fastener into a workpiece by using an explosive powder charge to accelerate a piston which ultimately expels the fastener through physical contact therewith. In general, the tools resemble guns, having a barrel, housing, trigger, firing mechanism, charge and load (fastener). Such tools have been in existence for some time and are well disclosed in the patent literature. As powder actuated tools utilize a firing pin to ignite the powder charge, it is necessary to cycle the firing pin to a position where it is ready to fire. This has been done in the prior art by forcing a pin or a carrier for the pin into a ready to fire position against the action of a pair of coil springs. The linear compression force required to overcome the two coil springs, while certainly possible, and indeed operable, is relatively high. Such property causes the operator of the setting tool to need to bear down on the tool with considerably more force than might be desirable to place the setting tool in a position to dispense a fastener to the workpiece.

As will be appreciated by readers hereof, rapid completion of tasks is key in most endeavors whether they be private matters or commercial matters. High compression requirements as discussed above effectively slow the effort from both the time to compression standpoint and the operator fatigue standpoint. It is therefore understandable that high compression requirements to use a setting tool are not desirable as they negatively impact production. Since production must stay high, setting tools having lower compression requirements would be of benefit to the art.

SUMMARY

Disclosed herein is a powder actuated setting tool including a housing, a barrel in operable communication with the housing, a trigger mechanism at the housing and a rotary firing pin resetting mechanism in operable communication with the trigger mechanism.

Further disclosed herein is a method for resetting a firing pin in a powder actuated setting tool including imparting a torsional spring force to a firing pin resetting mechanism, extending a barrel of the setting tool to remove an impediment to rotational movement of the firing pin, and rotating the firing pin in response to the torsional spring force.

BRIEF DESCRIPTION OF THE DRAWINGS

Referring now to the drawings wherein like elements are numbered alike in the several Figures.

DETAILED DESCRIPTION

Figure 1:
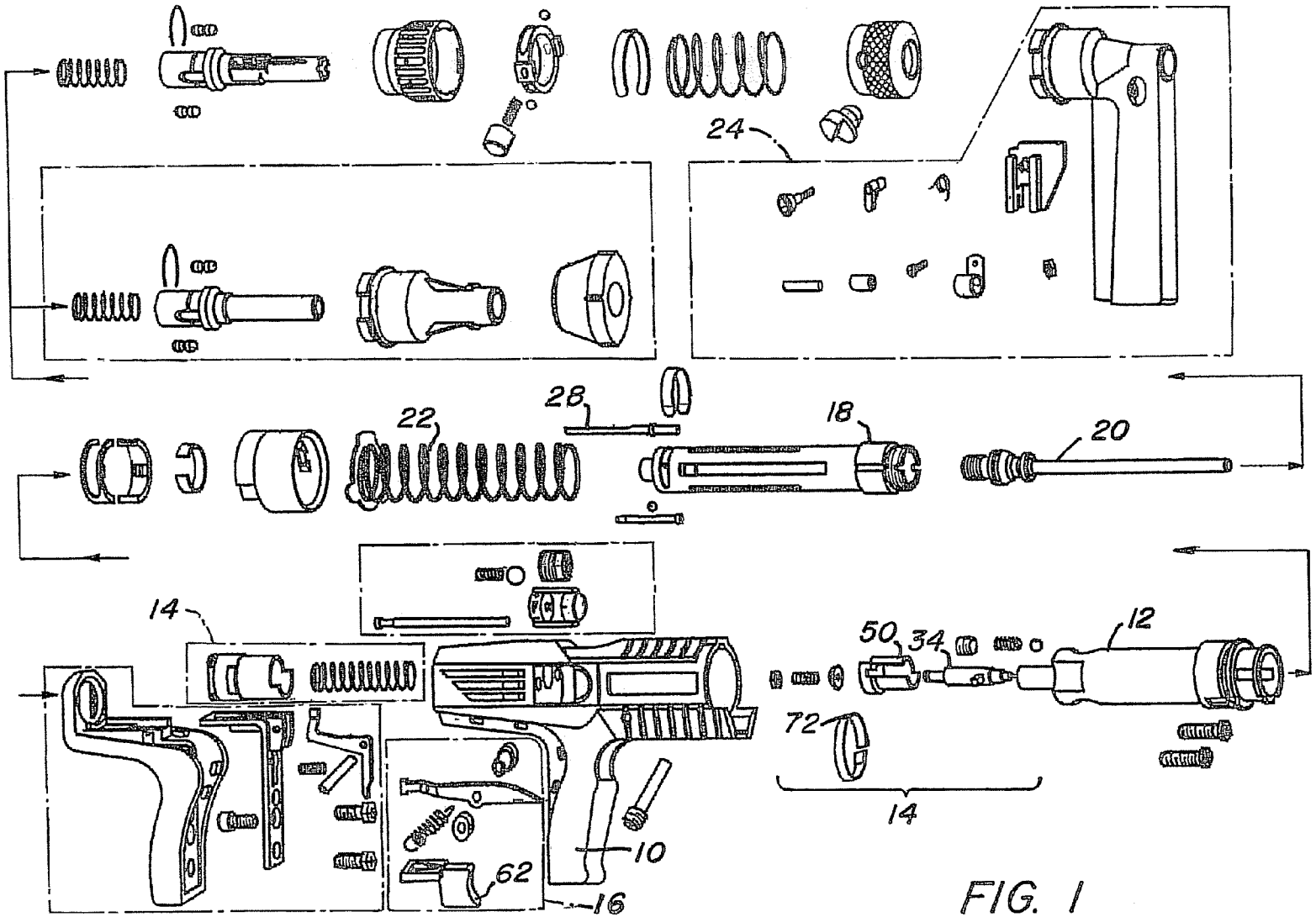
FIG. 1 is an exploded view of a setting tool having a firing pin reset mechanism according to this disclosure.

Referring to FIG. 1, a housing 10 is easily recognizable. Housing 10 contains when assembled, barrel guide 12, firing mechanism 14, trigger assembly 16 and a barrel 18. Other components of the setting tool are not directly related to the object of this disclosure include, a barrel 18, a piston 20, a barrel set spring 22, and a fastener magazine assembly 24. Further illustrated is a firing mechanism reset finger 28 which causes movement of the firing mechanism when the barrel is cycled due to operator compression of the setting tool.

Figure 2:
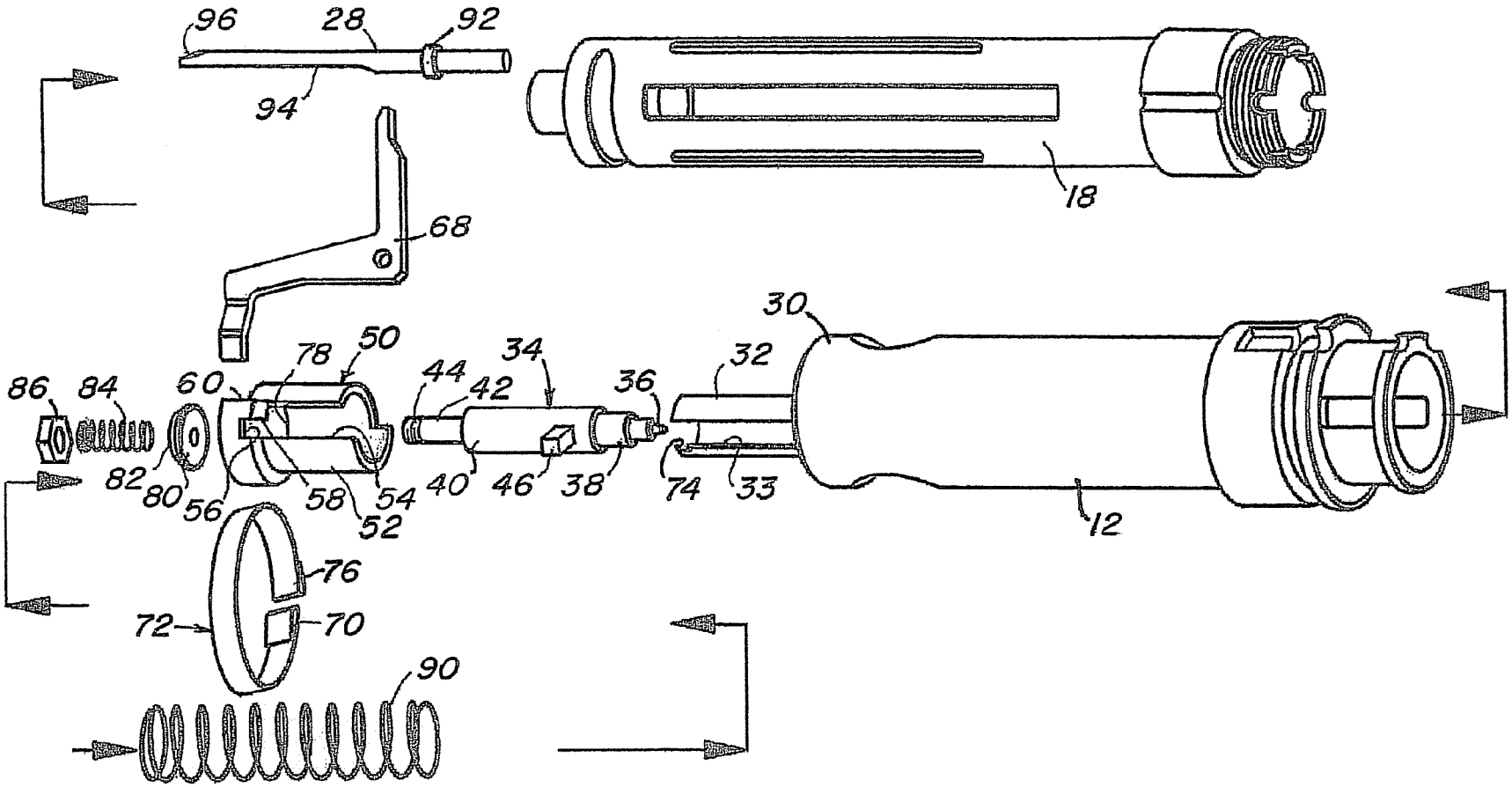
FIG. 2 is an exploded view of components of the setting tool relevant to the firing pin reset mechanism.

Referring to FIG. 2, an enlarged view of the components of the setting tool that are particularly relevant to this disclosure and together function as a firing pin resetting mechanism, among other functions is illustrated. From FIG. 1, the reader should recognize barrel guide 12 and barrel 18. This provides an indication of where in the setting tool the particular components described hereunder reside. For clarity, it is noted that the right side of drawing FIG. 2 will be oriented to the forward extent of the setting tool and the left side of the drawing toward the rearward extent of the setting tool. At a rearward end 30 of barrel guide 12 is a pin guide 32 to guide a firing pin 34 to a powder charge (not visible) in a combustion chamber (not visible) within the barrel 18. Pin guide 32 includes a slot 33 for sliding passage of a portion of the firing pin 34 discussed hereunder. The firing pin itself includes an impact pin 36, a stepped support 38 for impact pin 36, a body 40 and a pin pullback arm 42 having thread 44. Further, body 40 supports, protruding radially therefrom, a reset land 46. Land 46 is about half as wide as slot 33 for operational reasons that will become clear hereinafter. The firing pin 34 is receivable not only within the inside dimension of pin guide 32 but within pin rotator 50. Pin rotator 50 includes a substantially cylindrical body 52 having an opening 54 therein extending over at least a portion of the body 52, and having a width similar to that of slot 33 to accommodate movement of reset land 46 and reset finger 28 during cycling of the firing mechanism. It should be noted that when assembled, guide 32, firing pin 34 and rotator 50 are substantially circumferentially nested and coaxial.

Rotator 50 further includes a land receptor 56 sized to receive land 46 when the firing mechanism is in the ready to fire position. Receptor 56 is illustrated as one embodiment but it is important to note that the only surface of receptor 56 that is necessary to operation of the firing mechanism is surface 58 for it is surface 58 that causes the rotational movement of land 46 which allows the firing pin 34 to be accelerated toward a powder charge. Rotator 50 also includes a trigger lever recess 60, making rotator 50 responsive to trigger 62 of the setting tool. The trigger lever 68 causes trigger action to interact with rotator 50 and thereby release firing pin 34 by pushing land 46 off of finger 28 pin 34 is propelled forwardly to strike the powder charge.

When assembled, guide 32 anchors one end 70 of a torsion spring 72 at anchor 74. The other end 76 of torsion spring 72 is anchored at rotator 50 at anchor 78. Torsion spring 72 acts to return rotator 50 and thus firing pin 34 to a "ready to set" position after firing of the setting tool by urging rotator 50 rotationally to a settable position. Torsion spring 72 is covered by disk 80 which also acts as a base for firing spring 90. In one embodiment disk 80 includes shoulder 82 sized to receive spring 90 thereon. Pin pullback 42 extends slidably through disk 80 and a pullback spring 84 to engage a nut 86 on thread 44. The pullback spring 84 operates to pullback the firing pin 34 slightly to remove contact between the impact pin 36 and a charge.

Finger 28 has been introduced above but not in context. Still referring to FIG. 2, finger 28 is connected to barrel 18. In this embodiment finger 28 is inserted into a recess in barrel 18 (not in view) up to shoulder 92 and is secured there by reasonable means. Finger 28 is shaped to include a slide area 94 parallel to an axis of finger 28 which interacts with land 46.

Operation of the firing mechanism is interrelated with compressive action on the tool causing barrel 18 to cycle into barrel guide 12. As noted above, this occurs when the tool is in use by compressing the tool against a workpiece. Since finger 28 is fixedly connected to barrel 18, finger 28 moves with barrel 18.

Figure 3A:
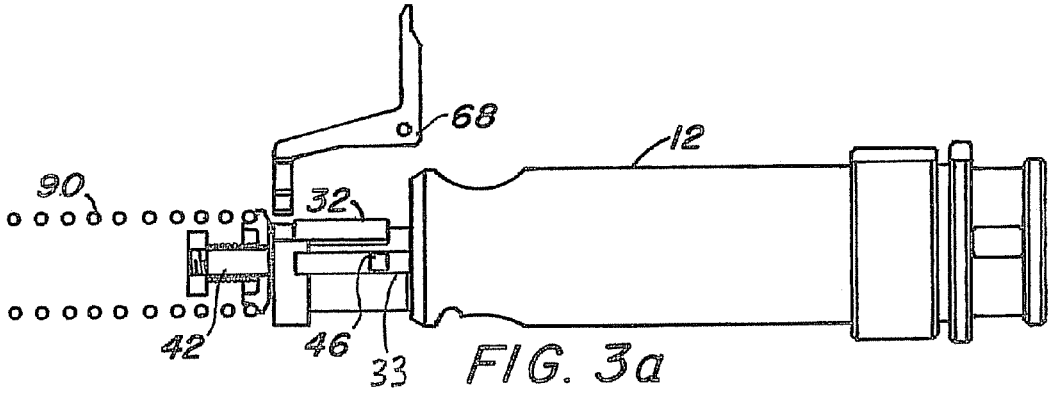
FIGS. 3*a*–3*d* are a series of views of the assembled firing pin reset mechanism illustrated in sequential positions.

With the information from the preceding paragraph, reference is made to FIGS. 3*a*–3*d* wherein sequential views of the resetting mechanism are provided. In FIG. 3*a* the tool is in the "just fired" position and the compressive force released with the firing pin forward (rightward in the drawing). Finger 28 is not visible in FIG. 3*a* verifying that compressive force on the setting tool is not present and the land 46 is in position to be actuated by finger 28 upon compression of the setting tool. Components of the pin can be seen in the drawing to verify its location. These are land 46 and arm 42. Spring 90 is shown in an uncompressed condition as it is extended to cause the firing pin to move forwardly into contact with the powder charge.

Figure 3B:
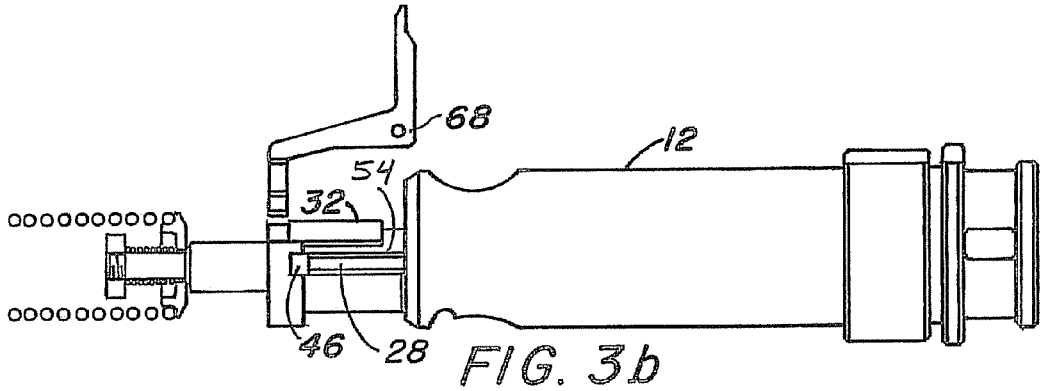

Moving to FIG. 3*b*, finger 28 has moved leftwardly in the figure to urge firing pin 34 rearwardly in the setting tool against the spring 90. Land 46 is moved into receptor 56 by finger 28 which is itself moved due to compression of the setting tool and therefore barrel 18 movement. Spring 90 is compressed by the same movement. In the position illustrated in FIG. 3*b*, the tool is ready to fire.

Figure 3C:
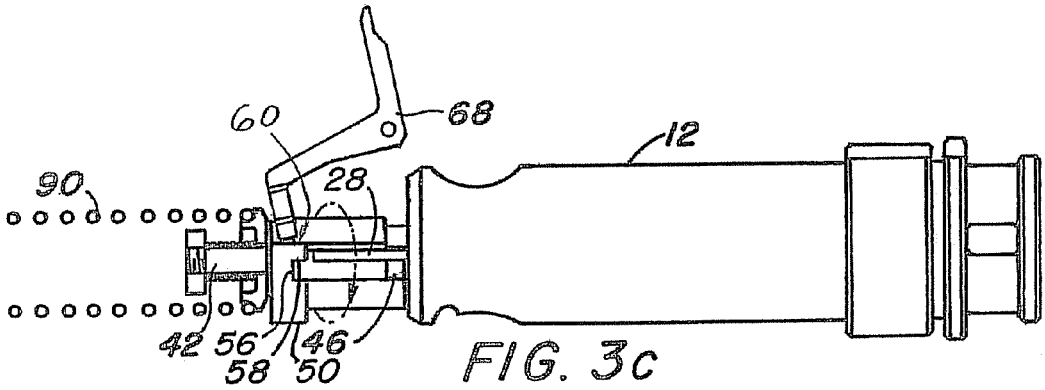

Referring to FIG. 3*c*, the trigger lever 68 is actuated causing contact between lever 68 and recess 60. This contact urges rotator 50 to rotate in the direction of the arrow in FIG. 3*c* against the spring force of spring 72 (not visible in FIG. 3*c*). Firing pin 34 is caused to rotate in the same direction as rotator 50 due to contact between land 46 and surface 58 of rotator 50. As rotation of rotator 50 aligns surface 58 with surface 94 of finger 28, land 46 is no longer supported in the "cocked" position and immediately moves forwardly (right in drawing) under the force of spring 90. The firing pin 34 is illustrated, through the components thereof that are visible, in the fired position, already having been moved by spring 90.

Figure 3D:
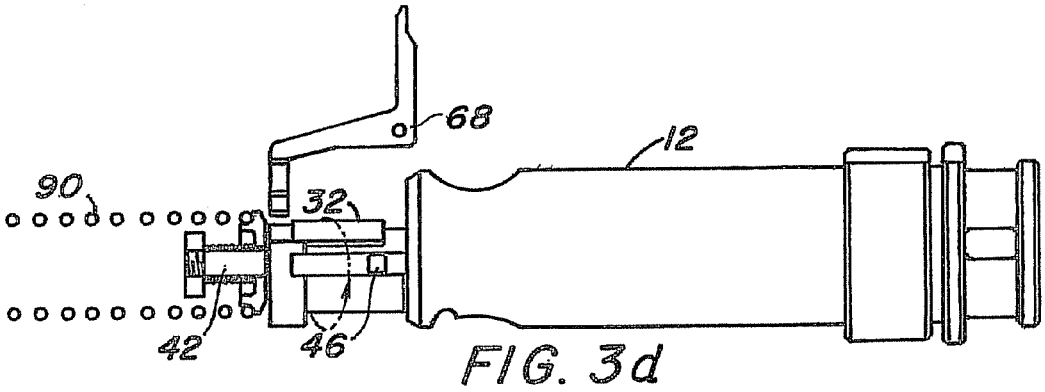

Rotator 50 remains in the position of FIG. 3*c* until finger 28 is moved rightwardly (forwardly) due to uncompression of the setting tool, until land 46 is no longer prevented from rotating in the direction of the arrow in FIG. 3*d* (illustration after removal of finger 28 and rotation of rotator 50 and land 46). At this point in the process, the setting tool is back in the uncompressed ready for compression (and "cocking") position.

This arrangement as disclosed eliminates a coil spring that was required in the prior art and by doing so reduces overall compressive force needed to set the tool.

While one embodiment has been shown and described, modifications and substitutions may be made thereto without departing from the scope of the invention. Accordingly, it is to be understood that the present invention has been described by way of illustration and not limitation.

What is claimed is:

1. A method for resetting and firing a powder actuated setting tool comprising:

torsionally urging a portion of a firing pin into axial alignment with a finger of a barrel of the tool;

compressing the barrel of the tool toward a housing of the tool, the finger urging the portion of the firing pin to a ready position; and rotating a rotator and the firing pin to a position where the portion of the firing pin is unsupported by the finger.

2. The method for resetting and firing a powder actuated setting tool of claim 1 wherein a spiral torsion spring provides the torsional urging.

3. The method for resetting and firing a powder actuated setting tool of claim 1 wherein the rotating of the rotator is against the torsional urging.

4. The method for resetting and firing a powder actuated setting tool of claim 1 wherein the torsional urging automatically reverses the rotation of the rotator and the firing pin.

* * * * *